United States Patent [19]

Kozai

[11] 3,949,833

[45] Apr. 13, 1976

[54] SAFETY DEVICE FOR LIFTER-EQUIPPED EXTENSIBLE LADDER VEHICLE

[75] Inventor: Tetsuo Kozai, Higashiosaka, Japan

[73] Assignee: Morita Pump Kabushiki Kaisha, Osaka, Japan

[22] Filed: Nov. 8, 1974

[21] Appl. No.: 522,317

[52] U.S. Cl. ..... 182/19; 182/103

[51] Int. Cl.[2] ..... E06C 7/12

[58] Field of Search ..... 182/19, 103, 102, 141, 182/63–68

[56] References Cited

UNITED STATES PATENTS 2,894,605 7/1959 Leavitt ..... 182/103

3,693,755 9/1972 Terayama ..... 182/102

*Primary Examiner*—Reinaldo P. Machado

*Attorney, Agent, or Firm*—Hall & Houghton

[57] ABSTRACT

A device for use with a high-altitude working vehicle provided with a vertically and horizontally revolvable and extensible ladder and an operator-carrying lifter movable up and down along the ladder, the device being characterized in that it allows the exension and contraction of the ladder only when the lifter is at a predetermined position, thereby securing safety of the operator riding in the lifter. Other advantages and details of the construction will be made clear.

4 Claims, 7 Drawing Figures

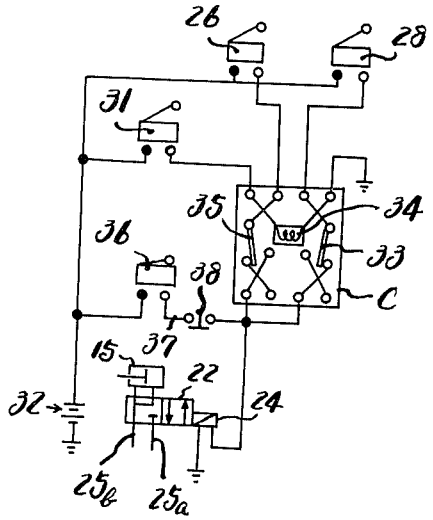
Fig 4
Fig 5
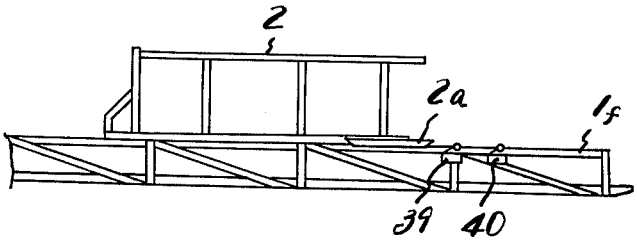
Fig 6
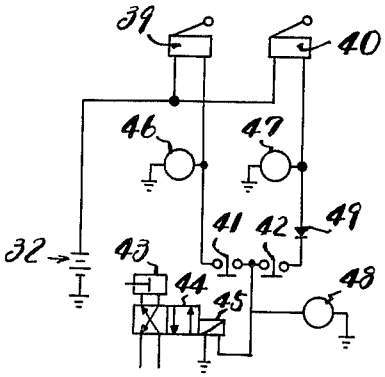

SAFETY DEVICE FOR LIFTER-EQUIPPED EXTENSIBLE LADDER VEHICLE

BACKGROUND OF THE INVENTION a. Field of the Invention

The present invention relates to a high-altitude working vehicle provided with a vertically and horizontally revolvable and extensible ladder and an operator-carrying lifter movable along said ladder, and more particularly it relates to a safety device for said lifter.

b. Description of the Prior Art

In an extensible ladder vehicle of the type described, a lifter is mounted on the ladder and moved up and down to carry out high-altitude work. In this connection, it should be mentioned that if the ladder is extended or contracted when the lifter is located at positions other than a lowered storage position on the ladder, this is very dangerous. Heretofore, almost no attention has been paid to this point.

SUMMARY OF THE INVENTION

The present invention provides a safety device adapted to control the extension and contraction of the ladder so that it allows the extending and contracting operation of the ladder when the lifter is located at a predetermined lowered position while it prohibits said operation when the lifter is located at other positions.

BRIEF DESCRIPTION OF THE DRAWINGS

FIG. 4 is an electric diagram for the automatic extension and contraction stopping unit;

FIG. 5 is side view of the upper end portion of the ladder;

FIG. 6 is an electric circuit diagram for an automatic lifter stopping unit.

DESCRIPTION OF THE PREFERRED EMBODIMENT

Figure 1:
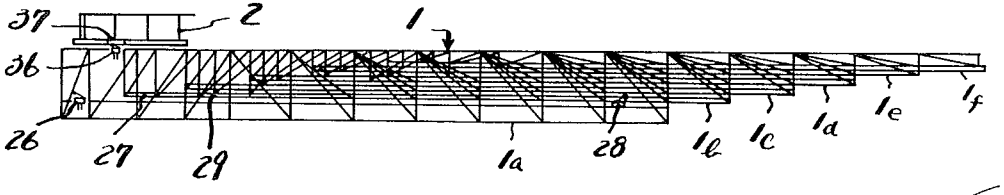
FIG. 1 is a side view of a ladder.
Figure 2:
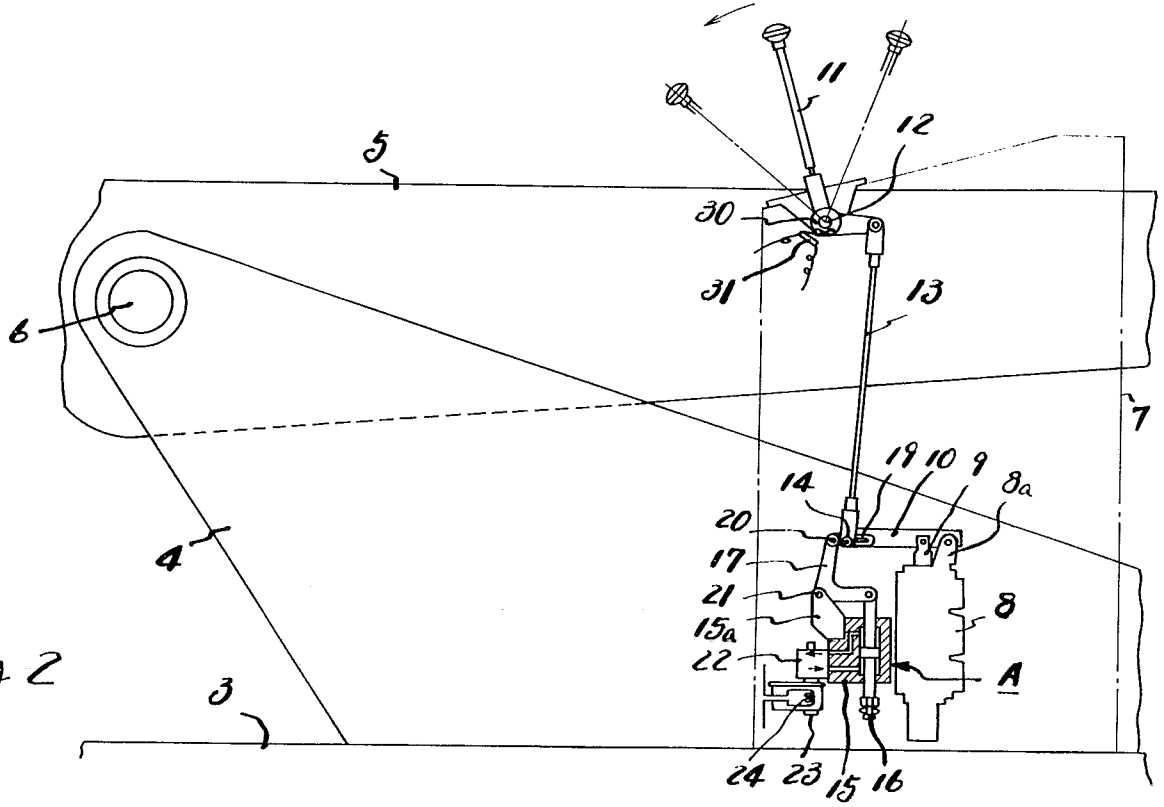
FIG. 2 is a side view of a ladder extending and contracting unit.

In FIG. 1, an extensible ladder 1 is shown as a six-stage ladder comprising the first-stage ladder 1*a*, the second-stage ladder 1*b*, the third-stage ladder 1*c*, the fouth-stage ladder 1*d*, the fifth-stage ladder 1*e* and the sixth-stage ladder 1*f*. The character 2 designates a lifter adapted to be moved up and down along ladder. As shown in FIG. 2, the ladder 1 is mounted on a ladder inclination correcting frame 5 pivotally supported by a support frame 4 on a turntable 3 at the rear of a vehicle. The character 6 designates a pivot shaft and 7 designates a control tower mounted on the turntable. A changeover valve 8 for a ladder extension and contraction hydraulic cylinder is vertically installed in the lower portion of the tower. A valve spool 9 is connected to a changeover lever 10 at an intermediate portion thereof pivotally mounted on a bracket 8*a* on a valve box. A ladder extension and contraction operating lever 11 is pivotally mounted on a shaft 12 in the upper portion of the control tower 7. A connecting rod 13 is connected at its upper end to the operating lever 11 and at its lower end to the front end of the changeover lever 10 through a pin 14. When the operating lever 11 is tilted from the neutral position to the extension or contraction side, the spool 9 of the changeover valve 8 is moved from its neutral position to its lower or upper position, thereby extending or cotracting the ladder. An automatic ladder extension and contraction stopping unit A is associated with the changeover lever 10 in the following manner.

Figure 3:
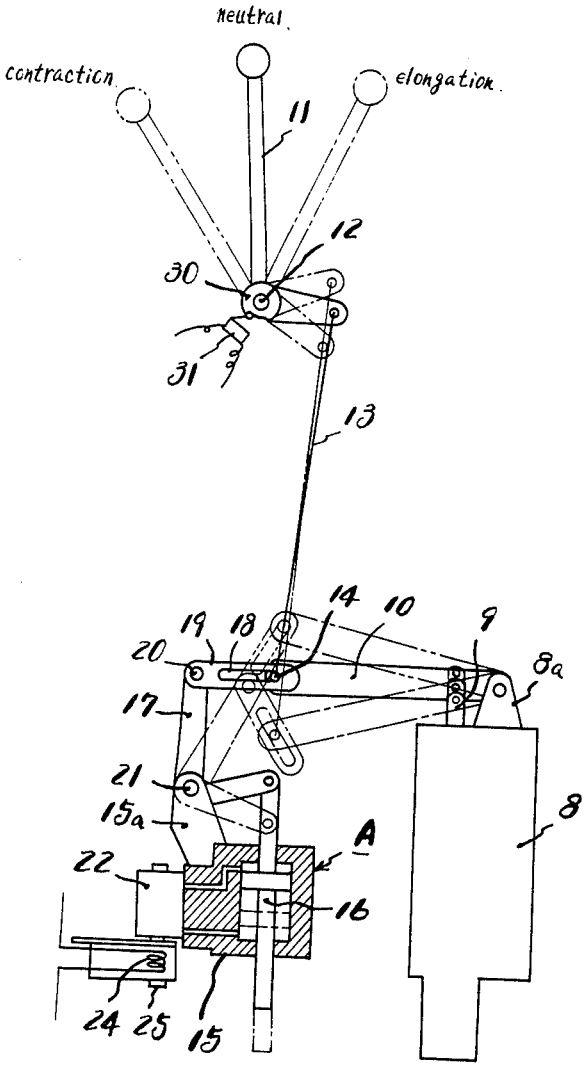
FIG. 3 is a view explanatory of the operation of an automatic stop motion unit associated with said ladder extending and contracting unit.

A master cylinder 15 is erected below the front end of the changeover lever 10 and has its piston rod 16 pivotally connected to the horizontal arm end of an L-lever 17 pivotally supported on a bracket 15*a* on the upper side of the cylinder. One end of a link 19 having an elongated opening 18 is pivotally connected to the vertical arm end of said lever 17 by means of a pin 20, as shown in FIG. 3. The character 21 designates a lever shaft. The pin 14 is slidably fitted in said elongated opening 18. A solenoid valve 22 is integrally attached to the master cylinder 15 with the piping therebetween being omitted for convenience of illustration. The character 23 designates the spool of the solenoid valve 22 and the character 24 designates the solenoid of said valve. The master cylinder 15 and solenoid valve 22 are placed in a hydraulic circuit shown in FIG. 4, in which the character 25*a* designates a high pressure line and the character 25*b* designates a low pressure line. When the solenoid 24 is not energized, the interior of the master cylinder 15 is in communication with the hydraulic line 25*b* on the low pressure side. In this condition, the operating lever 11 can be manipulated for extension and contraction of the ladder without being obstructed by the master cylinder 15. When the solenoid 24 is energized to change over the spool 23 of the solenoid valve 22, high pressure oil is admitted into the master cylinder 15 to extend the piston rod 16 as shown in solid lines in FIG. 3 so that the L-lever 17 is turned with the pin 20 on the vertical arm end thereof being displaced to the left. As a result, even if the operating lever 11 has been tilted to the extension side as shown in alternate long and short dash lines in FIG. 3 with the changeover lever 10 and link 19 being in their lower bent position or even if the operating lever 11 has been tilted to the contraction side as shown in alternate long and two short dashes lines with the changeover lever 10 and link 19 being in their upper bent position, the above-mentioned leftward displacement of the elongated opening 18 to a position intermediate between said upper and lower positions causes the lever 10 to return to its neutral position, whereupon the extension or contraction of the ladder is stopped. In short, the energization of the solenoid 24 of the solenoid valve 22 stops the extension or contraction of the ladder.

The electric circuit of the automatic ladder extension and contraction stopping unit A will now be described.

As shown in FIG. 1, a full-contraction limit switch 26 is provided at the rear of the first-stage ladder 1*a* and a switch abutment plate 27 therefor is provided at the rear of the second-stage ladder 1*b*. A full-extension limit switch 28 is provided at the front end of the first-stage ladder 1*a* and a switch abutment plate 29 therefor is provided at the rear of the second-stage ladder 1*b*. Further, as shown in FIG. 3, a cam 30 is secured to the extension and contraction lever shaft 10 and a cam switch 31 is installed adjacent said cam switch. It is so arranged that the cam switch 31 is closed by the cam 30 when the operating lever 11 is tilted to the contraction side while it is opened when the lever 11 is in an angular position between the neutral and extension positions. The switches 26, 28 and 31 are electrically connected to a power source 32, a control relay C and the solenoid 24, as shown in FIG. 4. When the ladder 1 is extended until the abutment plate 29 abuts against the normal open full-extension limit switch 28, the latter is closed so that electric current flows from the power source 32 through the switch 28, the movable contact 35 of the control relay C and the solenoid 24 to energize the latter whereupon the extension of the ladder is stopped as described above. When the extension and contraction operating lever 11 is tilted to the contraction side to contract the ladder, the cam switch 31 is closed to energize the solenoid 34 of the relay C so that the movable contact 35 is connected to a circuit leading to the solenoid 24. When the abutment plate 27 abuts against the normal open full-contraction limit switch 26 to close the latter, electric current flows from the power source 32 through the switch 26, the movable contact 35 of the relay C and the solenoid 24 to open the latter, whereupon the contraction of the ladder is stopped as described above.

A normally closed limit switch 36 is provided at the lifter stop position on the base portion of the first-stage ladder 1*a*, it being so arranged that when the lifter 2 is at this position, the switch 36 is opened by an abutment plate 37 attached to the lifter and that when the lifter 2 is moved away from said position, the switch 36 is closed. As shown in FIG. 4, the switch 36 is placed in the electric circuit of the automatic ladder extension and contraction stopping unit between the power source and the solenoid valve 22 of the master cylinder 15 for automatic stoppage. An electric wire 37 between the switch 36 and the solenoid 24 of the solenoid valve 22 is disposed on the control tower 7 and connected to a manual switch 38 on an operating panel.

In operation, the manual switch 38 is closed and when the lifter 2 is not at its predetermined position on the ladder 1, the limit switch 36 is in its closed position so that electric current flows through the switches 36 and 38 and the solenoid 24 to energize the latter whereupon the spool is changed over and hence the automatic ladder extension and contraction stopping unit A is actuated. And the ladder extension and contraction operating lever 11 is locked in its neutral position. Further, when the lifter 2 is at its predetermined position on the ladder 1, the solenoid valve 22 is not energized throgh the limit switch 36 since the latter is opened by the abutment plate 37 abutting said limit switch 36. As a result, the automatic ladder extension and contraction stopping unit A is not actuated, thus making it possible to extend or contract the ladder. In addition, with the lifter 2 being stopped at a position intermediate between the ends of the ladder in an extended position when it is desired to further extend or contract the ladder, since the operating lever 11 has been locked in its neutral position the manual switch 38 has to be opened to unlock said lever, whereupon the extending and contracting operation becomes possible.

In addition, the automatic stoppage of the upward and downward movement of the lifter 2 is effected in the following manner.

As shown in FIG. 5, a first limit switch 39 and a second limit switch 40 are provided at the front end portion of the sixth-stage ladder 1*f* and spaced apart from each other lengthwise of the ladder with a suitable distance therebetween. An abutment plate 2*a* of a length spanning the distance between said switches is provided on the lifter 2 to extend lengthwise of the ladder so as to be opposed to said switches. As shown in FIG. 6, the switches 39 and 40 are electrically connected to a power source 32 and to switches 41 and 42, respectively, mounted on the operating panel of the control tower 7, said switches 41 and 42 being electrically connected to the solenoid 45 of a solenoid valve 44 for an automatic lifter stopping master cylinder 43. Red pilot lamps 46 and 47 connected to the above-mentioned switch circuits, respectively, are arranged on said operating panel. A buzzer 48 is attached to the vehicle at a suitable location thereon and is connected to a circuit between the switches 41, 42 and the solenoid 45. In addition, the lifting and lowering unit and automatic stopping unit for the lifter are constructed in the same manner as in said ladder extending and contracting unit and automatic stopping unit for the ladder.

With the switches 41 and 42 closed prior to the operation of the lifter 2, when the operating lever is tilted to the lifting side, the lifter 2 is lifted along the extended ladder 1. When the abutment plate 2*b* on the lifter abuts against the first limit switch 39 to close the latter, the lamp 46 is lit and the buzzer 48 vibrates while the solenoid valve 44 is actuated to operate the automatic lifter stopping master cylinder 43 whereby the operating lever is returned to its neutral position. At this time, since the switch 42 is in its closed position, electric current tends to flow through the lamp 47, but a diode 49 prevents the lamp from being lit.

Figure 7:
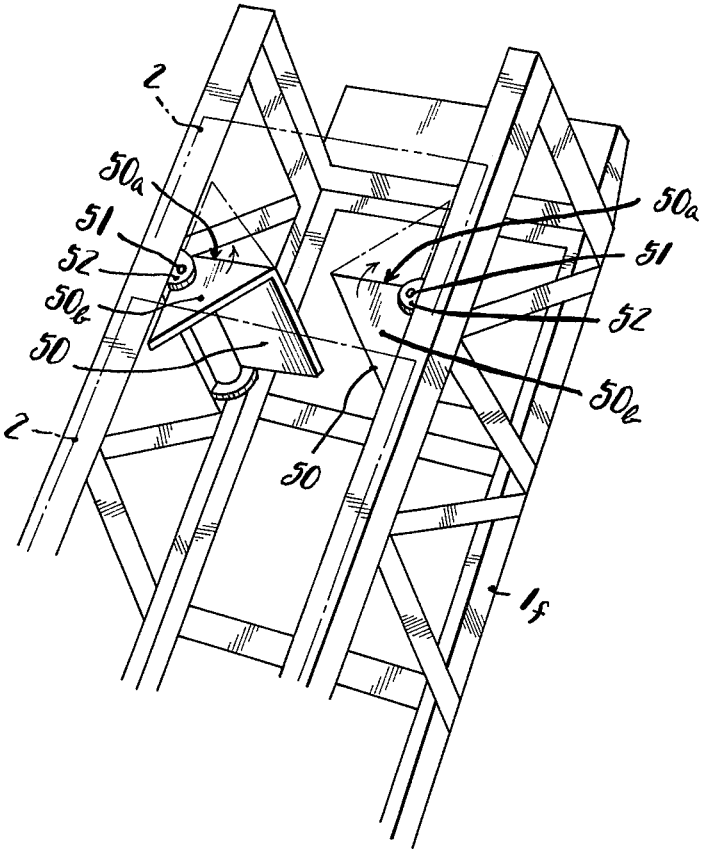
FIG. 7 is a perspective view of a water discharge operation platform.

In the above-mentioned conditions, the lifter 2 has been stopped just short of steps 50 as shown in alternate long and short dash lines in FIG. 7 while closing the first limit switch 39. The steps 50 are attached to the interior of the ladder on either side thereof so that the operator may operate a water discharge gun (not shown) at the front end of the ladder while he is standing on the upper surfaces 50*a* of the steps. The character 51 designates a step pivot; 52, a pivotally mounting member on the step side; and 50*b*, a lateral abutment plate attached to a step and adapted to abut against the lateral ladder surface during use but when it is not used it may be folded so as not to become an obstruct as shown in chain lines.

In the above-mentioned conditions when it is desired to lift the lifter 2 a little farther beyond the steps as shown in alternate long and two short dashes lines for the purpose of refuge, rescue or the like, the switch 41 has to be opened as shown in FIG. 6. Thereupon, the buzzer 48 stops. Further, since the operating lever is released from its locked condition, it is possible to lift the lifter 2. At this time, since the limit switch 39 has been closed by the abutment plate 2*a*, the lamp 46 remains lit. When the second normal open limit switch 40 is closed by the abutment plate 2*a* as a result of the upward movement of the lifter, the lamp 47 is lit and the buzzer 48 vibrates while the solenoid valve 44 is energized to cause the master cylinder 43 to return the lever to its neutral position, whereupon the lifter 2 is stopped at the intended position. When it is desired to lower the lifter 2, the switches 41 and 42 are opened to allow the lowering operation. When the lifter is lowered to a predetermined position, the operating lever is manually operated to stop the lifter or, though not shown, it may be so arranged that an automatic lowering stop motion limit switch is closed by the lifter to actuate the above-mentioned automatic stop motion unit.

As has been described so far, the present invention provides a safety device for a lifter-equipped extensible ladder vehicle comprising a limit switch provided either on the ladder or on the lifter and adapted to be opened when the lifter assumes a predetermined position on the ladder and closed when the lifter moves away from said predetermined position, said limit switch being placed in an electric circuit for an automatic ladder extension and contraction stopping unit and connected between a power source and a solenoid valve for an automatic stop motion master cylinder, the arrangement being such that when the lifter is at the predetermined position the extending and contracting operation of the ladder is allowed while said operation is prevented when the ladder is at a position other than said predetermined position. Thus, the present invention enables a lifter-equipped extensible ladder to be used with safety.

While there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. In a working vehicle having a turntable at one end of the vehicle, a support frame assembly mounted on said turntable, an extensible multi-stage ladder assembly unit mounted at one end to said support frame assembly, an operator carrying lifter unit mounted on said ladder assembly unit and movable along its length thereof, an automatic ladder extension and contraction stopping unit, said ladder stopping unit including an automtic stop motion master cylinder and a solenoid valve for said cylinder, said ladder stopping unit having an electric circuit for actuating said ladder stopping unit, an automatic lifter stopping unit, an electric circuit for actuating said lifter stopping unit, and a power source for said electric circuits, the improvement of a safety device for the ladder assembly unit, said safety device comprising a limit switch incorporated in said electric circuit for said ladder stopping unit, said limit switch being connected between said power source and said solenoid valve, said limit switch being open when the lifter unit is in a predetermined position on said ladder assembly unit to permit the operation of said ladder assembly unit, and said limit switch unit being closed when the lifter unit is in other than the predetermined position to prevent the operation of the ladder assembly unit.

2. In a working vehicle in accordance with claim 1, wherein the limit switch will be open when the lifter unit is at the lower end of the ladder assembly unit.

3. In a working vehicle in accordance with claim 1, wherein the ladder stopping unit includes upper and lower limit switches and the limit switch is connected in parallel with said upper and lower limit switches.

4. In a working vehicle in accordance with claim 1, the further inclusion of a manual switch connected in series with the limit switch, said manual switch being normally closed and being manually opened at a predetermined time.

* * * * *